United States Patent [19]

Prochaska

[11] Patent Number: 5,025,848

[45] Date of Patent: Jun. 25, 1991

[54] TEMPORARY WINDOW SHADE

[76] Inventor: Maria J. Prochaska, 10153 1/2 Riverside Dr., Suite 326, Toluca Lake, Calif. 91602

[21] Appl. No.: 512,256

[22] Filed: Apr. 20, 1990

[51] Int. Cl.[5] ..... A47H 23/00

[52] U.S. Cl. ..... 160/368.1; 160/354; 160/263; 160/243

[58] Field of Search ..... 160/368.1, 263, 354, 160/402, 349.1, 340, 242, 243, 257, 290.1

[56] References Cited

U.S. PATENT DOCUMENTS

| | | | |
|---|---|---|---|
| 1,615,931 | 2/1927 | Cann | 160/243 X |
| 4,119,134 | 10/1978 | Morken | 160/349.1 |
| 4,221,256 | 9/1980 | Karaki | 160/368.1 |
| 4,539,239 | 9/1985 | Graves et al. | 160/263 X |
| 4,836,265 | 6/1989 | Bussert | 160/354 |

*Primary Examiner*—Blair M. Johnson
*Attorney, Agent, or Firm*—Albert O. Cota

[57] ABSTRACT

An improved temporary window shade (10) that is designed to cover a window opening during the period when a person is awaiting the arrival and installation of a permanent window covering. The shade (10) consists of a non-woven, translucent material (12), having imprinted on its surface a grid (14) of vertical and horizontal lines that allows the material to be accurately and easily cut to size. The material (12) may be attached to either a window (50), a window sash (52) or to a wall (56) that surrounds a window frame (54). The attachment is made by first attaching a material attachment means, such as a two-sided adhesive tape (16), to the attachment structure. The material's upper edge (12*c*) is then pressed against the two-sided tape to hold the material in place. The shade (10) may bge partially raised by attaching at its lower corners a bendable strip (20). The materials's (12) lower edge (12*d*) is then raised, folded over itself and the outward ends of the bendable strip are bend and pressed against the inward material to thus hold up the folded section.

3 Claims, 3 Drawing Sheets

TEMPORARY WINDOW SHADE

TECHNICAL FIELD

The invention pertains to the general field of window shades and covers and more particularly to a temporary window shade that can be easily installed, raised and removed.

BACKGROUND ART

The purchaser of a new home or in many cases a renter vary often will purchase custom made window drapes, louvered blinds or shades to add utility and an aesthetic appearance to a room. Since these custom made window covers are made to order to fit a specific window or room decor, a period of time is required from the time the order is placed to the completion and hanging of the cover.

During this waiting period, in order to protect privacy as well as to block-out bright sunlight, the window openings are often covered with makeshift window covers. The temporary covers include such items as bedsheets, blankets and the like, and in many cases the exposed window is even soaped. These coverings are often unsatisfactory since they are a nuisance to hang and remove and there is no convenient method that allows the temporary window covers to be raised or lowered which, on occasion may be desirable.

A search of the prior art did not disclose any patents that read directly on the claims of the instant invention however, the following U.S. patents were considered related:

| U.S. PAT. NO. | INVENTOR | ISSUED |
|---|---|---|
| 4,836,265 | Bussert | 6 June 1989 |
| 4,562,675 | Baigas. Jr. et al | 7 January 1986 |
| 4,539,239 | Graves et al | 3 September 1985 |
| 3,913,655 | Ogino | 21 October 1975 |

The Bussert patent discloses a temporary window shade for use in buildings which have not yet had permanent draperies or blinds installed. The shade is made from a sheet of hemmed disposable material and includes stiffener strips on the top and bottom hems; the top hem is attachable to the wall above a window. The bottom stiffener strip includes hooks which are receivable in slots formed along the side edges of the shades to hold the bottom edge of the shade in a raised configuration.

The Baigas patent discloses an insulated assembly that is positioned onto a window surface. The insulator is comprised of a high loft body of bonded together synthetic fibers and a sheet of plastic adjacent thereto. The plastic has heat insulative properties and allows the transmission of incident light.

The Graves patent discloses a flexible sheet member that is used in a window shade assembly. The sheet member is comprised of a sheet of flexible plastic material having an upper surface and a lower surface. Longitudinally from the upper to the lower surface is located one or more continuous cutting lines. The cutting lines can be cut to fit the width of the particular window being fitted.

The Ogino patent discloses a temporary curtain kit consisting of two elongated strips of stiffener material. The material has an adhesive coating on one or both sides thereof and a sheet of paper curtain material. The strips are attachable to the curtain material with at least one of the strips being attachable to both the curtain material and a housing wall.

DISCLOSURE OF THE INVENTION

The improved temporary window shade is designed to provide an attractive, easy to install material that is temporarily attached to a window opening. The shade is attached during the time that a home owner or renter is awaiting for their new drapes or other permanent window covers to arrive and be hung.

The shade consists of a disposable non-woven, translucent material. On at least one surface of the material is imprinted a grid of vertical and horizontal lines. The grid allows the material to be accurately and easily cut to the correct size and provides a pattern that is aesthetically pleasing to the eye.

The cut material is easily attached to either the window, window sash or to a wall surface surrounding the window frame. The attachment is preferably accomplished by the placing a strip of two-sided adhesive tape to at least the upper section of the window, window sash or wall. The remaining adhesive backing is removed from the tape and the upper edge of the material is pressed against the tape to the hold the material in place. To allow the attached material to be partially raised, a bendable strip, usually made of pliable metal, is attached near and across the lower edge of the material with the outward ends of the bendable strip extending across the material's left and right side edges. The material is then raised and folded over itself and the outward ends of the bendable strip are bent over the inward material to hold up the folded section. The raised shade then can allow direct light to enter a room or provide an unobstructed outside view. The strip also functions as a weight that allows the material to maintain a flat, straight surface.

In view of the above disclosure, it is the primary object of the invention to provide a simple, aesthetic and effective shade for temporarily covering a window opening. In addition to the primary object, it is also an object of the invention provide a temporary shade that:

is easy to install and remove, can be inexpensively constructed of biodegradable, disposable material, is cost effective from both a manufacturers and consumer point of view, can be easily raised and lowered and, provide a practical replacement for bedsheets and newspapers when used as temporary window covers.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
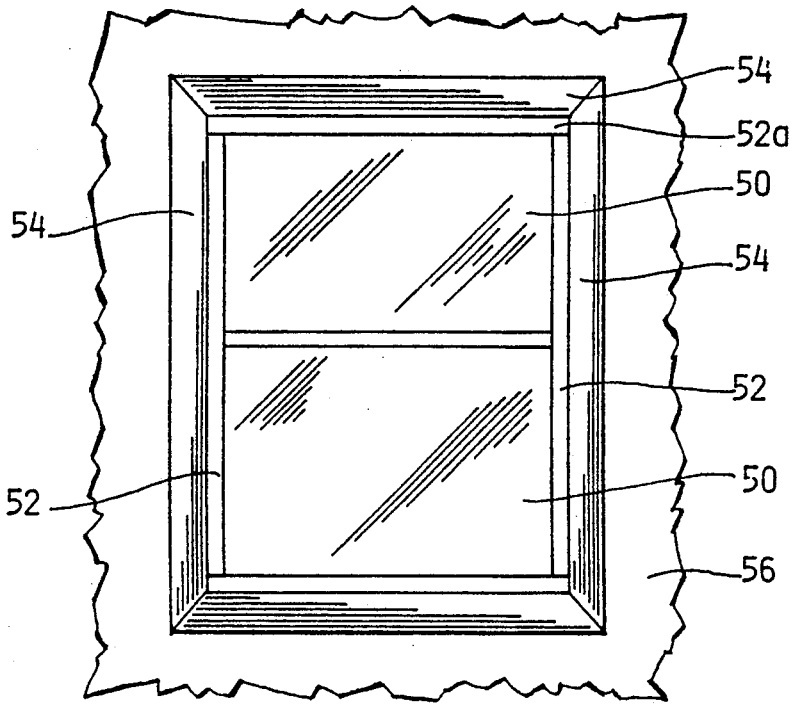
FIG. 1 is a front elevation view of a typical window assembly to which the improved temporary window shade is attached.

The best mode for carrying out the improved temporary window shade 10 is presented in terms of a preferred embodiment that is designed to provide a simple and effective method for temporarily covering a window opening. The shade 10 as shown in FIGS. 1–13 is comprised of three major elements: a disposable, non-woven material 12 that has a grid 14 imprinted on its surface, a material attachment means 16 and a shade opening means 18.

The shade 10 is used to cover a window opening that typically consists, as shown in FIG. 1, of a window assembly. The assembly comprises a window 50 that is held by a window sash 52 that, in turn, is bordered by a window frame 54. The entire assembly is then recessed within a structural wall 56.

Figure 2:
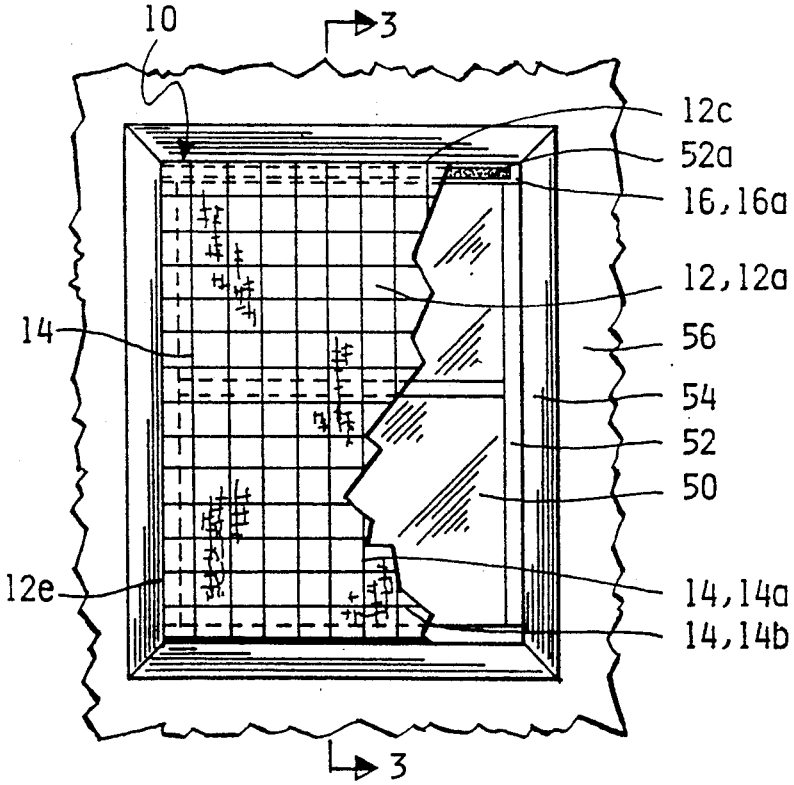
FIG. 2 is a front cut-away view of a shade attached to the window sash.
Figure 3:
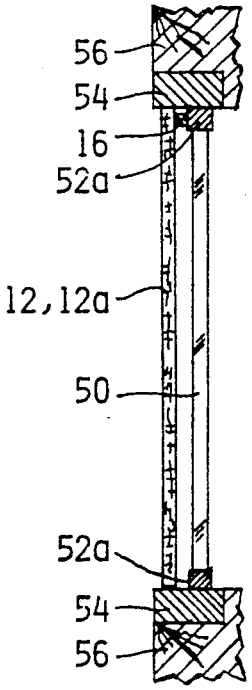
FIG. 3 is a side sectional view of the shade taken along lines 3—3 of FIG. 2.

The material 12, as shown attached in FIGS. 2 and 3, is configured to have a front surface 12*a*, a back surface 12*b*, an upper edge 12*c*, a lower edge 12*d*, a left side edge 12*e* and a right side edge 12*f*. In its preferred embodiment, the material is produced in a solid color with white preferred, may be biodegradable and can be easily rolled to facilitate shipment and storage.

Figure 4:
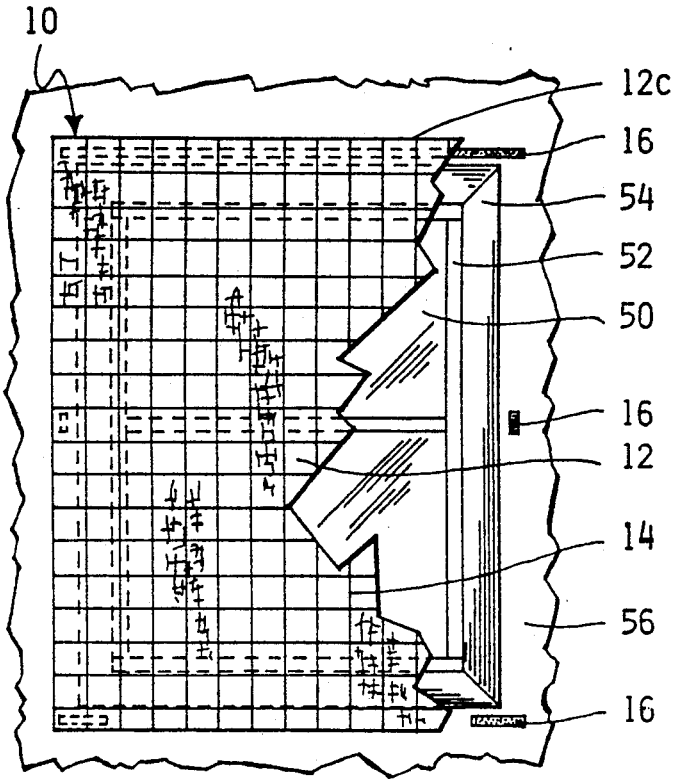
FIG. 4 is a front cut-away view of a shade attached to the wall surrounding the window assembly.

One of the problems encountered in attaching the material to a surface surrounding the window is in the sizing, cutting and placement of material. To alleviate this problem, on at least one surface and preferably the front surface 12*a*, there is imprinted the grid 14 that consists of vertical and horizontal lines 14*a*, 14*b* as shown in FIGS. 2 and 4. The grid allows the material 12 to be accurately and easily cut to the correct size. In experimenting with the grid size, it was found that a 4-inch by 4-inch grid square (10.16 cm by 10.16 cm) provided an optimum size for most material cutting operations. However, any reasonable grid size fulfills the intent of the grid.

Figure 5:
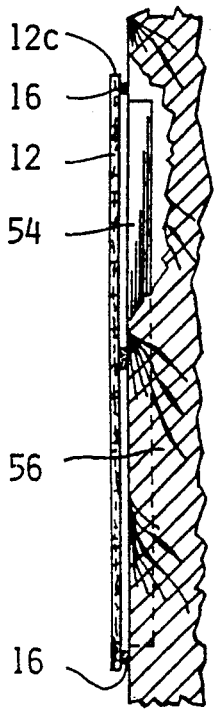
FIG. 5 is a side cut-away view of the shade as attached in FIG. 4.
Figure 6:
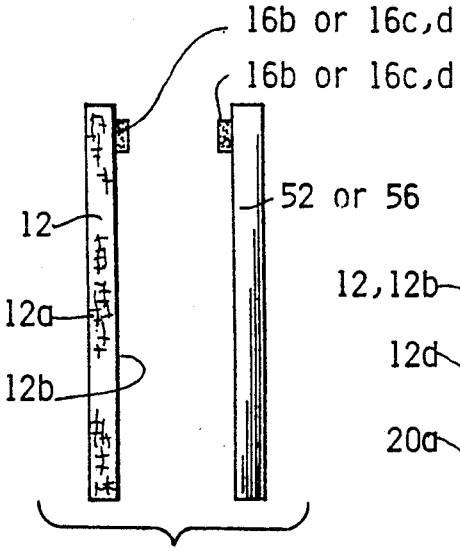
FIG. 6 is a partial side view of a typical material attachment means.
Figure 7:
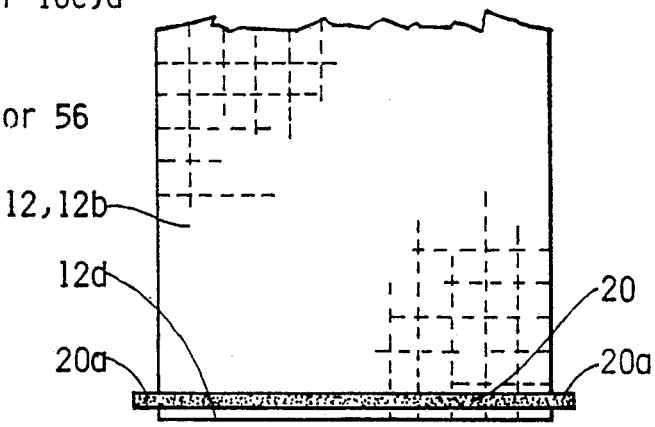
FIG. 7 is a partial front elevation view showing the pair of bendable strips attached to the material's lower left and right side edges.

Two schemes for attaching the cut material 12 to a window 50 are disclosed: in the first scheme, as shown in FIGS. 2 and 3, the material 12 is cut to fit the window sash 52 and is attached to at least the upper section 52*a* of the sash by a material attachment means 16. In the second scheme, as shown in FIGS. 4 and 5, the material 12 is cut to fit around the wall 56 surrounding the window frame 54 and is attached to at least the upper section of the wall by the material attachment means 16.

The preferred attachment means 16 is comprised of a two-sided adhesive tape 16*a* of the type manufactured by the 3M Company and other companies. One side of the tape is affixed to and across the width of at least the upper section of the attachment structure, i.e., the upper section 52*a* of the window sash 52, as shown in FIG. 2. The attaching means may also consist of hook and loop fasteners 16*b*, also known by their registered trademark Velcro or by a first and second magnetic strip 16*c*, 16*d*. In these later two fastening means one side of the fastening combination is preferably applied to and across the width of the attachment structure and the other side to the material's back surface 12*b* near its upper edge 12*c* as shown typically in FIG. 6. In some cases, in lieu of affixing the attachment means across the entire width of the structure, it may be affixed at each upper corner. Upon the joining of the fasteners two sides, the material 12 is attached. Although it is only necessary to attach the material 12 at its upper edge 12*c*, if desired, for additional security and privacy, the attachment means may also be affixed to the material's lower edge 12*d* and/or to the left and right side edges 12*e*, 12*f* as shown in FIG. 4.

More often that not, the material 12 will be hung to cover the entire area of the window 50. However, in some situations, it way be desirable to include a shade opening means 18, that allows the material to be raised and held in place to provide a clear view and to allow direct light to enter the room.

Figure 8:
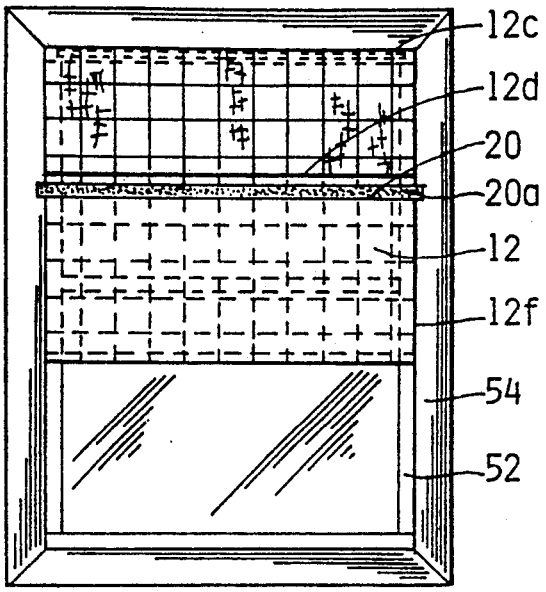
FIG. 8 is a front elevation view showing the material folded over itself with the outward ends of the two bendable strips bent over and pressed against the material to hold the material in a raised position.
Figure 9:
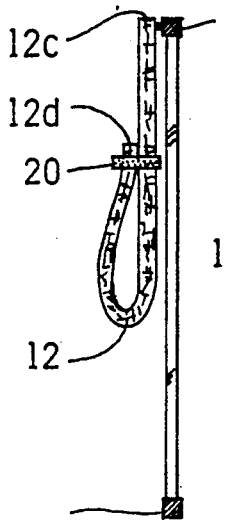
FIG. 9 is a side elevational view of the raised material as shown in FIG. 8.

Two shade opening means are disclosed: in the preferred means, as shown in FIGS. 8 and 9, a bendable metal strip 20 having outward ends 20*a* that extend across the left and right side edges 12*e*, 12*f* of the material is used. The strip is attached, by an attachment means such as a two-sided adhesive tape 16*a*, near and across the lower edge 12*d* of the material.

Figure 10:
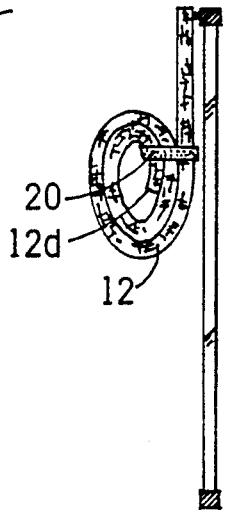
FIG. 10 is a side elevational view of the material rolled up and held in place by the two bendable strips.

To operate the preferred shade opening means, the extended outer ends 20*a* are grasped and the material 12 is raised and folded over itself as shown in FIGS. 8 and 9. The outward ends 20*a* are then bent over and pressed against the material to allow the material's lower edge 12*d* to be held in a raised position. In lieu of folding the material may be rolled and likewise attached as shown in FIG. 10.

Figure 11:
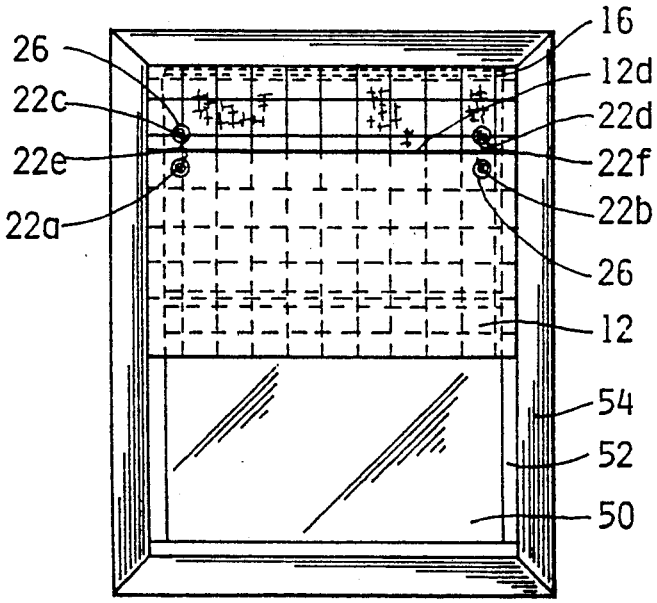
FIG. 11 is a front elevational view showing the material folded over itself and held in the upward position by means of a pair of bores and 'S' hooks combination.
Figure 12:
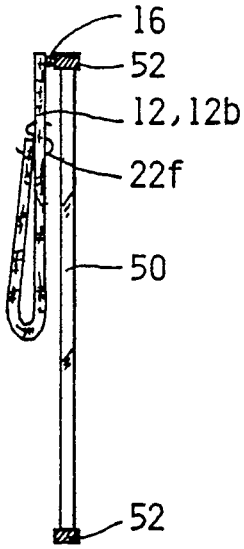
FIG. 12 is a side elevational view of the raised material as shown in FIG. 11.

In a second shade opening means 18 as shown in FIGS. 11 and 12, a first lower bore 22*a* and a second lower bore 22*b* are punches into the left hand corner and right hand corner respectively of the material's lower edge 12*d* as best shown in FIG. 11. An upward level distance from the lower edge 12*d* is then selected at which level a first upper bore 22*c* and a second upper bore 22*d* are punched in alignment with the respective lower bores 22*a*, 22*b*. To each bore may be attached a bore reinforcement washer 26 of the type normally used to reinforce loose-leaf notebook paper.

To operate the second shade opening means 18 one end of a metal or plastic first and a second 'S' hook 22*e*, 22*f* are hooked into the lower bores. The hooks are then grasped and the hook's free end is hooked over the upper bores 22, 22*d* to allow the material's lower edge 12*d* to be held in a raised position as shown in FIGS. 11 and 12.

Figure 13:
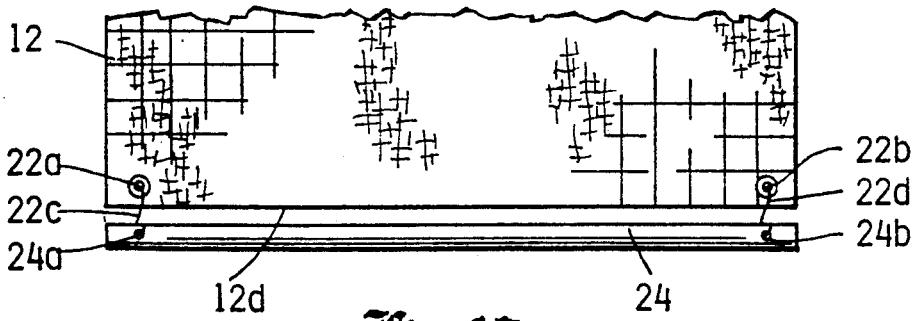
FIG.13 is a partial elevation view showing a bottom weight attached to the pair of bores on the material's lower edge.

To add further utility to the temporary shade 10, a bottom weight 24, as shown in FIG. 13, may be attached to the material's lower edge 12*d* to assure that the material 12 hangs and remains straight. The bottom weight 24 is configured in the shape of an elongated structure such as a wooden strip or circular rod. The structure includes a left hook bore 24*a* and a right hook bore 24*b*. To attach the weight 24, one end of a first 'S' hook is hooked over the left hook bore 24*a* and its other end is hooked over the first lower bore 22*a*. In a like manner, a second 'S' hook is hooked over the right hook bore 24*b* and the second lower bore 22*b*.

TEMPORARY SHADE ATTACHMENT SEQUENCE

To attach the material 12 to a typical attachment structure such as a window sash 52, the following steps are followed:

1. Measure the length and width of the window sash 52,

2. Cut the material to the size of the window sash by utilizing the grid 14 as a guide, 3. Apply one side of the two-sided adhesive tape 16*a* to at least the upper section 52*a* of the window sash 52, 4. Remove the adhesive backing from the two-sided adhesive tape affixed to the window sash, and 5. Attach the material to the window sash by pressing the upper edge 12*c* of the material against the two-sided adhesive type.

While the invention has been described in complete detail and pictorially shown in the accompanying drawings it is not to be limited to such details, since many changes and modifications may be made in the invention without departing from the spririt and the scope thereof. Hence, it is described to cover any and all modifications and forms which may come within the language and scope of the appended claims.

I claim:

1. An improved temporary window shade for covering a window opening, said shade comprising:

(a) a disposable, non-woven and translucent material having a front surface, a back surface, an upper edge, a lower edge, a left side edge and a right side edge, where said material comprises, on at least one surface, an imprinted grid consisting of vertical and horizontal lines, where said grid facilitates the sizing, cutting and placement of said material on the window surface or to a surface surrounding the window such as to at least the upper section of a window sash or the wall surrounding a window frame, (b) a material attachment means that allows said cut material to be attached to the window surface or to the surface surrounding the window, and (c) a bendable strip attached near and across the lower edge of said material by an attachment means, where the outward ends of said strip extend across the left and right side edges of said material, where when said material is raised, folded over itself and the outward ends of said bendable strip are bent over and pressed against said material, the lower edge of said material is held in a raised position.

2. An improved temporary window shade for covering a window opening such as a window sash, where said shade is comprised of a disposable, non-woven and translucent material having a front surface, a back surface, an upper edge, a lower edge, a left side edge and a right side edge, said material also having on at least one surface, an imprinted grid consisting of a symmetrical pattern of vertical and horizontal lines, where said grid facilitates the sizing, cutting and placement of said material on the window sash, where said shade is attached by application of the following steps:

(a) measure the length and width of the window sash, (b) cut said material to the size of the window sash by utilizing said grid as a guide, (c) apply one side of a two-sided adhesive tape to at least the upper section of the window sash, (d) remove the adhesive backing from the two-sided adhesive tape affixed to the window sash, and (e) attach said material to the window sash by pressing the upper edge of said material's back surface against the affixed said two-sided adhesive tape, and where, said shade is raised or lowered by application of the following steps:

(a) attach a bendable strip near and across the lower side edge of said material where the outward ends of said strip extend across the left and right side edges of said material, (b) grasp and raise the lower edge of said material to a desired level, (c) bend the outward ends of said bendable strip over said material to hold said shade in a raised position, and (d) to lower said shade unbend the outward ends of said bendable strip and allow said material to drop.

3. An improved temporary window shade for covering a window opening such as a wall surrounding a window frame, where said shade is comprised of a disposable, non-woven and translucent material having a front surface, a back surface, an upper edge, a lower edge, a left side edge and a right side edge, said material also having on at least one surface, an imprinted grid consisting of a symmetrical pattern of vertical and horizontal lines, where said grid facilitates the sizing, cutting and placement of said material on the wall surrounding a window frame where said shade is attached by application of the following steps:

(a) measure the length and width of the wall surrounding a window frame, (b) cut said material to the size of the wall surrounding a window frame by utilizing said grid as a guide, (c) apply one side of a two-sided adhesive tape to at least the upper section of the wall surrounding the window frame, (d) remove the adhesive backing from the two-sided adhesive tape affixed to the wall surrounding the window frame, and (e) attach said material to the wall surrounding the window frame by pressing the upper edge of said material's back surface against the affixed said two-sided adhesive tape, and where, said shade is raised or lowered by application of the following steps:

(a) attach a bendable strip near and across the lower side edge of said material where the outward ends of said strip extend across the left and right side edges of said material, (b) grasp and raise the lower edge of said material to a desired level, (c) bend the outward ends of said bendable strip over said material to hold said shade in a raised position, and (d) to lower said shade unbend the outward ends of said bendable strip and allow said material to drop.

* * * * *